United States Patent [19]

Gratkowski

[11] Patent Number: 4,503,894

[45] Date of Patent: Mar. 12, 1985

[54] WOOD SPLITTING DEVICE

[76] Inventor: Kazmer Gratkowski, Rte. #3, Decatur, Mich. 49045

[21] Appl. No.: 526,007

[22] Filed: Aug. 24, 1983

[51] Int. Cl.[3] ..... B27L 7/00

[52] U.S. Cl. ..... 144/193 A; 144/366; 144/193 K; 280/727

[58] Field of Search ..... 144/366, 3 K, 193 R, 144/193 A, 193 K; 280/727

[56] References Cited

U.S. PATENT DOCUMENTS

| | | | |
|---|---|---|---|
| 3,285,304 | 11/1966 | Fuller | 144/193 A |
| 3,779,295 | 12/1973 | Balsbaugh | 144/193 A |
| 4,086,111 | 4/1978 | Corey | 144/193 K |
| 4,254,808 | 3/1981 | Nokes . | |

OTHER PUBLICATIONS

Literature on log splitters illustrating conventional splitter.

*Primary Examiner*—W. D. Bray
*Attorney, Agent, or Firm*—Marmaduke A. Hobbs

[57] ABSTRACT

A wood splitting device for mounting on a vehicle, including a hydraulically operated log splitter. The wood splitter is capable of being pivoted from a horizontal position along one side of the vehicle to a vertical position at the rear of the vehicle or to any angular position therebetween, and is operational in any of these positions. The pivoting movement of the log splitter is powered by a hydraulic cylinder which moves guide and support arms pivotally connected to the splitter for supporting the splitter on the vehicle. The cylinder and the log splitter may be connected to the same hydraulic system, driven by an engine through a hydraulic pump and reservoir.

7 Claims, 7 Drawing Figures

WOOD SPLITTING DEVICE

BACKGROUND OF THE INVENTION

Wood is extensively used as a heating and/or cooking fuel in fireplaces or wood burning stoves, and preparing the wood for burning normally involves the steps of cutting the logs into manageable lengths, splitting the cut logs, loading and transporting the split pieces from the point of origin to the point of use, and unloading and stacking the wood in a convenient place at the point of use. Splitting the wood is a necessary step for large log segments to facilitate handling, drying, and use in the normally limited confines of a fireplace or wood-burning stove. In addition, splitting the log segments increases the available surface area of the wood which is then exposed to the flames upon burning, thus facilitating combustion. Loading, transporting, and unloading the wood from a trailer or truck may also be a necessary step since much usable wood is located in places remote from the point of use.

Splitting the log segments may either be accomplished manually, using a splitting maul or similar device, or with the aid of a hydraulically-operated log splitter, which substantially lessens the physical labor and effort required. A typical power splitter is a quite heavy, bulky device having a wedge-shaped blade driven by a hydraulic ram for splitting the wood. Many of these devices come equipped with wheels, and thus are somewhat portable; however, the weight, bulk, and awkward shape cause difficulties in transporting such devices over any substantial distance. In some cases, unsplit logs can be loaded and transported to the splitter for splitting at the point of use; however, split pieces are easier to handle and to load, and can be stacked closer together in the trailer or truck, making it normally more efficient and more economical to split the logs at the point of origin before they are loaded for transport to the point of use.

SUMMARY OF THE INVENTION

It is, therefore, one of the principal objects of the present invention to provide a wood splitting device having a hydraulically powered log splitter which is releasably mounted on a trailer for facilitating transport of the splitter to remote areas and for removing the splitter from the trailer for its use or storage elsewhere, and which is also pivotally mounted on the trailer, enabling its use in a horizontal position, a vertical position, or any of the various angular positions therebetween.

Another object of this invention is to provide a wood splitting device which allows the power splitter to be simply and easily connected to or disconnected from its mount and which is easily pivoted between horizontal and vertical positions.

A further object of the present invention is to provide a wood splitting device which can substantially lessen the physical labor involved in splitting and loading wood for transport to the point of use and which is durable in construction, offering substantial strength and a long service life.

A still further object of the present invention is to provide a wood splitting device which substantially reduces the time required to split and load the wood and which makes the operation more efficient and more economical.

These and other objects are attained by the present invention which relates to a wood splitting device, one embodiment having a hydraulically operated log splitter adapted to be carried by a vehicle, such as, for example, a trailer for transporting the splitter to remote work sites. The log splitter rests in a horizontal position on the side of the vehicle for transport and is pivotable between horizontal and vertical positions for the splitting operations. The splitter can be operated in either horizontal, vertical, or any of the angular positions therebetween. Pivotable guide means are included for guiding the pivoting movement of the log splitter, and a means, such as a hydraulic cylinder, is preferably used to move the guide means with the attached log splitter. The portability of the log splitter on the trailer and the ability of the splitter to pivot provided by the present invention, facilitate the wood gathering and splitting operation. The necessity of lifting large log segments or leaving them behind is eliminated by the present invention, thereby making the operation efficient, economical, and ecologically sound as the forest need not be littered by heretofore unusable large log segments.

DETAILED DESCRIPTION OF THE PREFERRED EMBODIMENT

Figure 1:
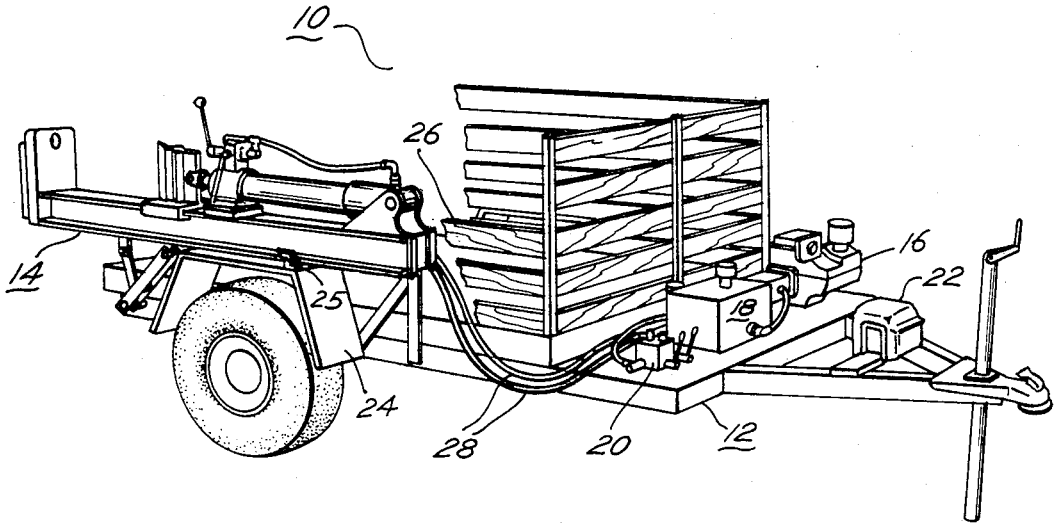
FIG. 1 is a perspective view of the wood splitting device embodying the present invention, shown here mounted on a trailer, the sides of the trailer being partially broken away.
Figure 2:
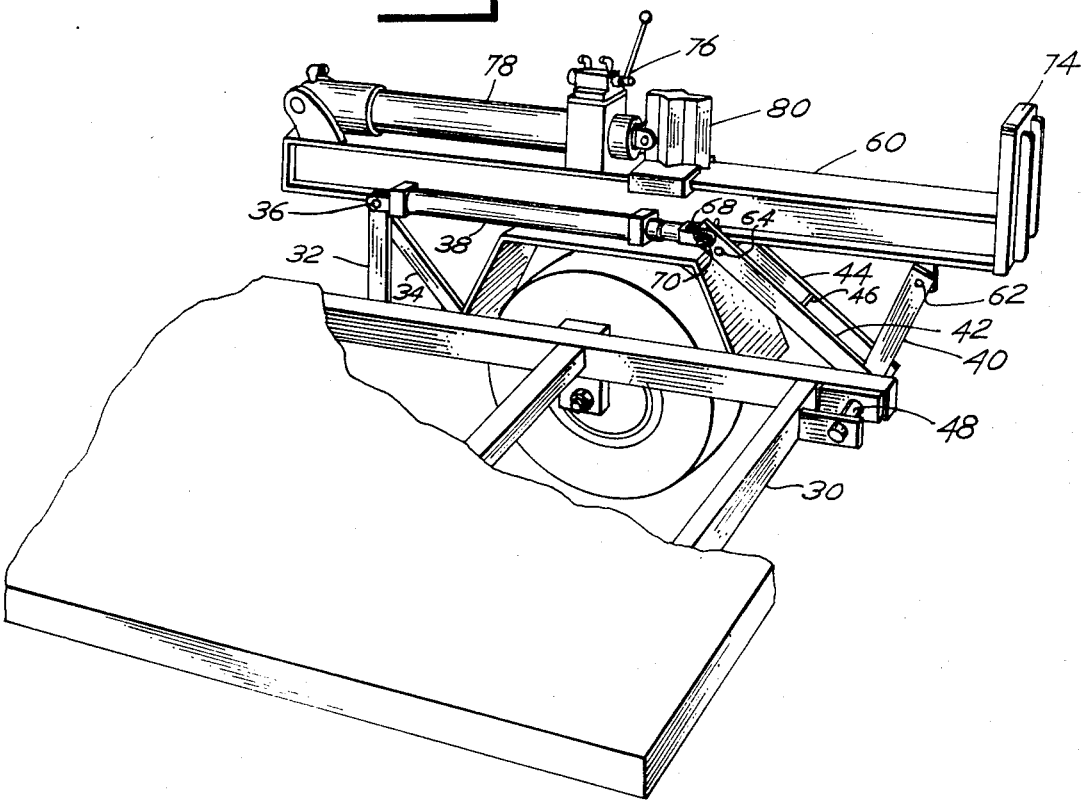
FIG. 2 is a perspective view similar to that of FIG. 1, taken from the opposite side, with the trailer bed partially broken away, detailing the attachment of the adjustment mechanism to the trailer frame.
Figure 3:
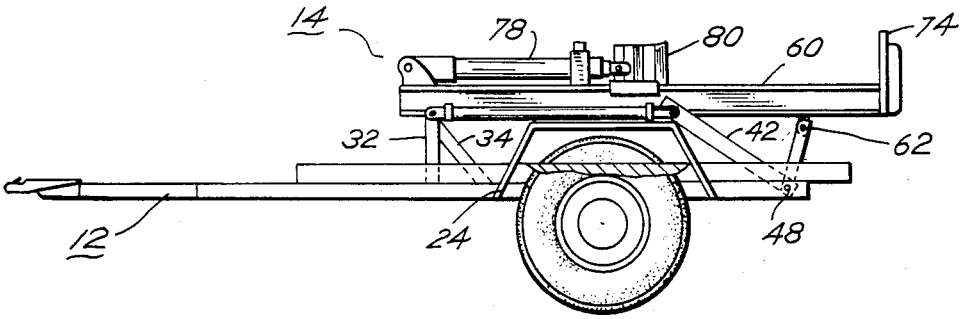
FIG. 3 is a partial, side elevational view of the present wood splitting device, looking across the trailer bed, illustrating the transport position and the horizontal use position.

Referring more specifically to the drawings, and to FIG. 1 in particular, numeral 10 designates generally the wood splitting device embodying the present invention. The device 10 is mounted on a trailer 12 and includes a hydraulically-operated log splitter 14, an engine 16 for providing power to the device, a hydraulic pump and reservoir 18 for providing a supply of hydraulic fluid, and controls 20 for operating the adjustment mechanism. A winch 22 is also provided for pulling large log segments to the device or for pulling the device to the area where the large log segments lie, after the device has been hauled to the work site by a truck or other vehicle. The device is shown in a horizontal position ready for transport, and has been designed for operation in this horizontal position, in the vertical position shown in FIG. 5, or in any of the various angular positions therebetween.

In the horizontal position shown in FIG. 1, the device is compactly arranged on a fender 24 of trailer 12 in a receiving clip 25, and has no protruding elements which could interfere with transport. In addition, with the present device in a horizontal position, log segments can be split and simply pushed over a lowered side wall 26 of the trailer, where they remain, ready for transport to the point of use. Engine 16 provides power for the adjustment mechanism, the log splitter 14, and the winch 22. Hydraulic pump and reservoir 18 provides a sufficient supply of hydraulic fluid for operating both the log splitter and the adjustment mechanism through lines or hoses 28.

The position adjustment mechanism is detailed in FIGS. 2 through 5. The log splitter is pivotally connected to the frame 30 of trailer 12 and can be pivoted for operation in horizontal, vertical or angular positions. Mounted on the trailer, in front of fender 24, is a rigid vertical support arm 32 and a rigid angular support arm 34. A pin 36 is inserted through arms 32 and 34 near their upper ends and is used to pivotally secure a double-acting hydraulic cylinder 38. A suitable fastener, such as a bolt or pin (not shown) is used to secure pin 36. The lower ends of arms 32 and 34 are secured to the trailer frame in a suitable manner, as by welding. Mounted behind the fender, near the rear of the trailer, is a pivotable single support arm 40, and pivotable double support arms 42 and 44 having a strengthening bar 46 therebetween. The lower ends of arms 40, 42, and 44 are pivotally secured to the trailer frame by a suitable means, such as pivot pin 48, and held thereon by another suitable fastener, such as a cotter pin (not shown). The opposite end of arm 40 is rigidly and releasably secured to the H-beam 60 of the log splitter by a suitable means such as bolt 62. The upper ends of arms 42 and 44 are rigidly and releasably secured to the sides of the H-beam above arm 40 with arm 42 on the inside and arm 44 on the outside of the H-beam, relative to the trailer. Suitable fastening means are used to secure arms 42 and 44 to the H-beam, such as pin 64 and a cotter pin (not shown). Arms 40, 42, and 44 thereby serve as guide means, controlling the movement of the log splitter under the power supplied by cylinder 38.

Figure 4:
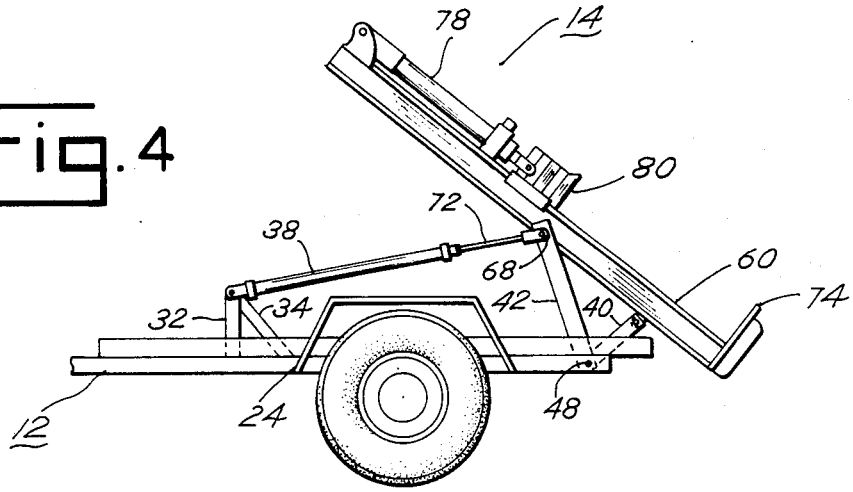
FIG. 4 is a partial, side elevational view of the wood splitting device similar to that shown in FIG. 3, illustrating an angular use position.
Figure 5:
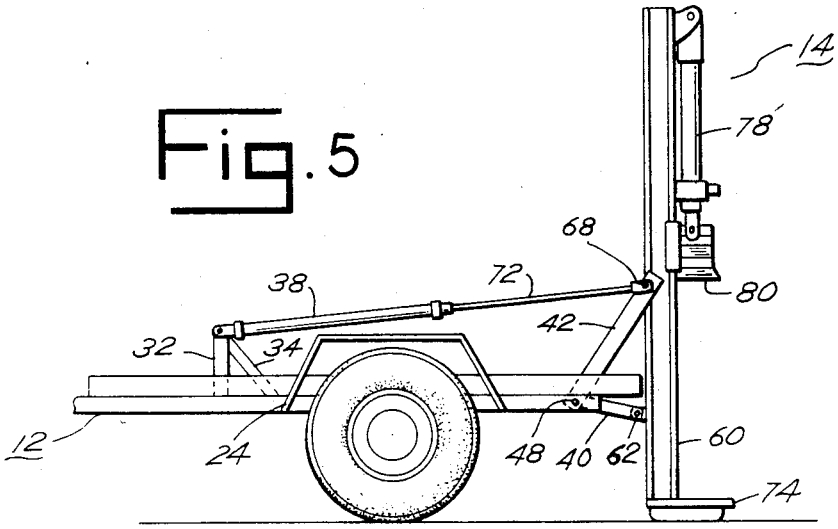
FIG. 5 is a partial, side elevational view of the wood splitting device similar to that shown in FIGS. 3 and 4, illustrating the vertical use position.

The opposite end of hydraulic cylinder 38 is pivotally secured to the upper end of arm 42 with means such as pin 68 and is held thereon by cotter pin 70. As cylinder 38 is activated from the horizontal position shown in FIG. 3, the end of the cylinder connected to arm 42 is projected outwardly from the body of the cylinder as shown in FIGS. 4 and 5. The projection of the cylinder arm 72 forces the log splitter and arms 40, 42, and 44 to pivot around pin 48, thus moving the splitter toward a vertical position. The device has been designed such that as cylinder 38 reaches its full extension, the anvil 74 or base member of the log splitter reaches and rests on the ground behind the trailer. As shown in FIG. 5, the cylinder is angled slightly upwardly from its horizontal position due to its pivotal mounting at the upper ends of arms 32 and 34. This sequence is reversed to pivot the log splitter from a vertical position to a horizontal position. As the double-acting cylinder 38 is activated and cylinder arm 72 is withdrawn into the body of the cylinder, arms 40, 42, and 44 cooperate with the cylinder to pivot the log splitter toward the horizontal position. While in a horizontal position, the splitter is compactly arranged on a side of the particular vehicle and has no outwardly protruding elements which could interfere with transport. In this position, the anvil 74 is almost flush with the rear of the vehicle. The support arms have been designed to cause the splitter to travel through an arc as pivoting occurs and to guide the splitter to a convenient working position. In the vertical position, the support and guide arms cause the splitter to assume a position adjacent the rear of the trailer or other vehicle.

As noted above, the log splitter 14 may be operated in horizontal, vertical, or angular positions. The end of a log segment is placed against anvil 74 and control lever 76 is used to activate a hydraulic ram 78, which drives a wedge 80 into the other end of the log segment, thus effecting the splitting of the log. With the splitter in a horizontal position, the split log segments can then be pushed into the trailer for transport. The vertical position is generally used for large, heavy log segments for splitting the segments into a more manageable size. In addition, any of the various angular positions between the horizontal and vertical positions may be used, as the size of the log segments or the available clearance dictates. The device exhibits substantial stability in any of these positions and the controls are always within convenient reach of an operator.

Figure 6:
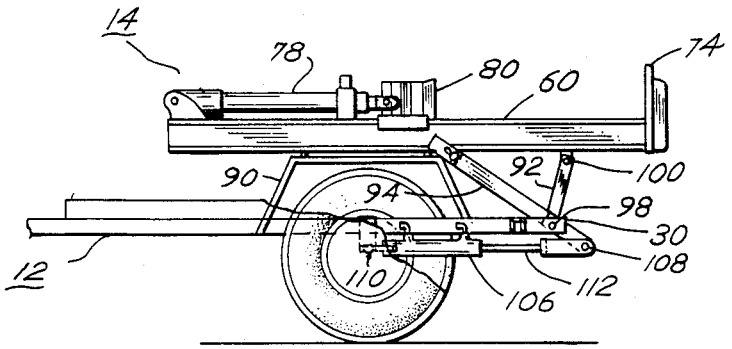
FIG. 6 is a partial, side elevational view, looking across the trailer bed, of an alternative embodiment of the wood splitting device embodying the present invention, illustrating the horizontal use position with the adjustment cylinder located beneath the trailer frame.
Figure 7:
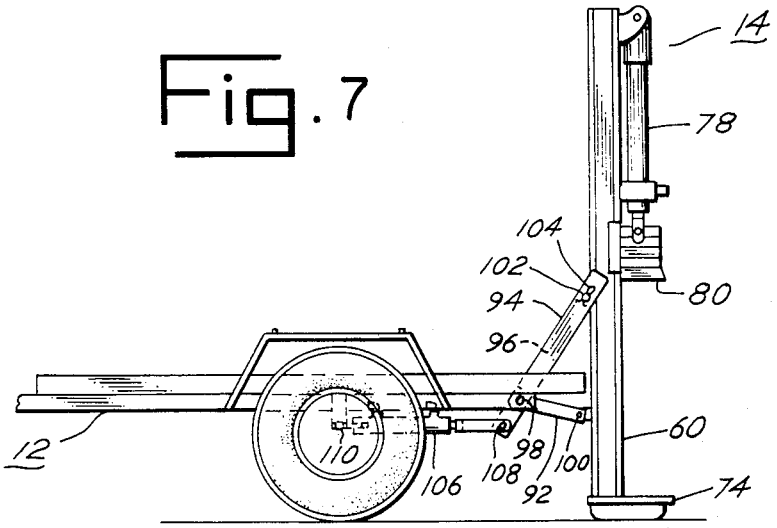
FIG. 7 is a partial, side elevational view of the alternate embodiment shown in FIG. 6, illustrating the vertical use position.

An alternative embodiment of the present wood splitting device is illustrated in FIGS. 6 and 7. The concept of this embodiment is the same as that of the first embodiment described above and it is alternatively usable depending on the structure of the particular trailer. In the horizontal position shown in FIG. 6, the splitter 14 is resting on a fender 90 of trailer 12. The splitter is connected to the trailer frame 30 by a pivotable single support arm 92 and pivotable double support arms 94 and 96, also having a strengthening bar (not shown) therebetween. The lower end of arm 92 is pivotally attached to the trailer frame using pin 98 and a suitable securing means such as a cotter pin (not shown). The opposite end of arm 92 is rigidly and releasably secured to H-beam 60 with a means such as bolt 100. The upper ends of arms 94 and 96 are rigidly and releasably secured to the sides of H-beam 60 using a pin 102 and a cotter pin 104, with arm 94 on the inside and arm 96 on the outside relative to the trailer. Arms 94 and 96 are pivotally mounted to the trailer frame with arm 92 by pin 98. The lower ends of arms 94 and 96 are pivotally secured to a double-acting hydraulic cylinder 106 using a pin 108, and are retained there with a means such as a cotter pin (not shown). The opposite end of cylinder 106 is rigidly secured to the trailer frame using bolt 110. In the horizontal position of FIG. 6, cylinder arm 112 is fully extended from the body of cylinder 106. As the splitter is pivoted to the vertical position of FIG. 7, cylinder arm 112 is withdrawn, causing arms 92, 94, and 96 to pivot and guide the splitter 14 toward a vertical position. The pivoting action can also be halted, as in the other embodiment described herein, with the splitter assuming any of the various angular positions between horizontal and vertical.

In the use and operation of the present wood splitting device, the log splitter 14 is releasably mounted on a trailer 12 for use in combination with the trailer or for transport to a remote location. The support structure and adjustment mechanism, comprising rigid support arms 32 and 34, pivotable support arms 40, 42, and 44, and hydraulic cylinder 38 in the first embodiment shown, cooperate upon activation of cylinder 38 to cause the log splitter to assume a horizontal, vertical, or any of the various angular positions therebetween. Disconnection from the trailer is normally effected with the splitter 14 in a vertical position by simply removing a cotter pin (not shown), pin 64, and bolt 62, which connect arms 40, 42, and 44 to H-beam 60, and the hydraulic lines 28 for cylinder 38. Connection to the trailer is a simple reversal of the above-described steps. The log splitter can be operated in any of the described positions by placing a log segment against anvil 74 and actuating hydraulic ram 78 with its attached splitting wedge 80.

The alternative embodiment described herein has a similar connection-disconnection sequence. Disconnection from the trailer is normally effected with the splitter 14 in a vertical position by removing cotter pin 104 and pin 102, which secure arms 94 and 96 to the H-beam 60, bolt 100 which secures arm 92 to the H-beam, and hydraulic lines 28 for cylinder 106. Connection to the trailer is a reversal of these steps. The present invention thus provides an efficient method of transporting the log splitter to remote work sites and the pivoting mechanism assures easy access to the splitter. This facilitates the splitting operation since any log segment can be split, regardless of its size or weight, by pivoting the splitter through an arc to an optimum position, and a ready transport vehicle is always available at the work site for transporting the split segments to the point of use.

While one embodiment of a wood splitting device and a modification thereof have been shown and described in detail herein, various other changes and modifications may be made without departing from the scope of the present invention.

I claim:

1. In combination, a vehicle with a frame and a bed thereon for hauling split wood, and a wood splitter mounted along the side of said bed, said wood splitter comprising:

(a) a beam disposed along said one side of said bed and having mounted thereon
  (1) a splitting wedge,
  (2) a power means for moving said wedge along said beam, and
  (3) an anvil at one end for holding wood for the splitting operation;

(b) a guide and support means for said beam, having
  (1) a pivot means connected to said vehicle frame, and
  (2) a radially extending member rigidly connected to one end to said beam and at the other end to said pivot means, for movement in a vertical plane parallel with said one side of said bed, for supporting said beam
    in a horizontal splitting operational position along said one side of said bed above said frame, with the anvil positioned at the rear end of the bed, and
    in a vertical splitting operational position at the rear end of said bed, with the anvil positioned near the ground, and (c) means for pivoting said guide and support means in said vertical plane and thereby moving said beam in an arc between said vertical and horizontal operational positions.

2. In combination, a vehicle and wood splitter as defined in claim 1 in which said pivoted guide and support means includes a first arm having one end secured to said beam and an opposite end pivotally mounted on said vehicle frame, and double support arms secured together and having upper ends secured to said beam and opposite ends pivotally mounted on said vehicle frame for guiding the movement of said wood splitter.

3. In combination, a vehicle and wood splitter as defined in claim 2 in which said power means for moving said wedge and said means for moving said pivoted guide and support means are double-acting hydraulic cylinders.

4. In combination, a vehicle and wood splitter as defined in claim 3 in which there are included an engine and a pump for supplying hydraulic fluid to said cylinders, a reservoir for storing the hydraulic fluid, and separate control means for operating said cylinders.

5. In combination, a vehicle and wood splitter as defined in claim 1 in which said vehicle is a trailer and includes a wheeled suspension with said frame supported by said suspension, and said pivot means supports said guide and support means in close proximity to the adjacent side of said bed on said frame.

6. The combination of a vehicle with a frame and a bed thereon for hauling split wood, and a wood splitter mounted along the side of said bed, said wood splitter comprising:

(a) a beam disposed along said one side of said bed and having mounted thereon
  (1) a splitting wedge,
  (2) a power means for moving said wedge along said beam, and
  (3) an anvil at one end for holding wood for the splitting operation;

(b) a guide and support means for said beam, having
  (1) a pivot means connected to said vehicle frame, and
  (2) a radially extending member rigidly connected at one end to said beam and at the other end to said pivot means, for movement in a vertical plane parallel with said one side of said bed, for supporting said beam
    in a horizontal splitting operational position along said one side of said bed above said frame, with the anvil positioned at the rear end of the bed, and
    in a vertical splitting operational position at the rear end of said bed, with the anvil positioned near the ground.

7. The combination of a vehicle and wood splitter as defined in claim 6, said guide and support means including a first arm having one end secured to said beam of the wood splitter and an opposite end pivotally mounted on the vehicle, and double arms secured together and having upper ends secured on opposite sides of the beam and opposite ends pivotally mounted on the vehicle for cooperating with said first arm to guide the wood splitter beam through an arc between horizontal and vertical positions.

* * * * *